US009957702B1

(12) United States Patent
Da Silva

(10) Patent No.: US 9,957,702 B1
(45) Date of Patent: May 1, 2018

(54) DEVICE FOR ELIMINATED BAD ODORS IN TWO-PIECE TOILETS

(71) Applicant: Maurício Santos Da Silva, Uberlândia (BR)

(72) Inventor: Maurício Santos Da Silva, Uberlândia (BR)

( * ) Notice: Subject to any disclaimer, the term of this patent is extended or adjusted under 35 U.S.C. 154(b) by 0 days. days.

(21) Appl. No.: 15/492,886

(22) Filed: Apr. 20, 2017

(51) Int. Cl.
*E03D 9/04* (2006.01)
*E03D 9/05* (2006.01)

(52) U.S. Cl.
CPC ..... *E03D 9/05* (2013.01)

(58) Field of Classification Search
CPC ..... E03D 9/04; E03D 9/05; A47K 13/307
USPC ..... 4/213, 211, 216, 348, 349
See application file for complete search history.

(56) References Cited

U.S. PATENT DOCUMENTS 2,309,774 A * 2/1943 Kistler ..... E03D 9/052 4/213
2,777,137 A * 1/1957 McFadden ..... E03D 9/052 4/213
4,494,255 A * 1/1985 Drummond ..... E03D 9/052 4/211
5,199,111 A * 4/1993 Antepenko ..... E03D 9/052 4/209 R
D338,712 S * 8/1993 Schaldenbrand ..... D23/311
5,522,093 A * 6/1996 Schaffer ..... E03D 9/05 4/209 R
6,073,273 A * 6/2000 Tillen ..... E03D 9/05 4/214
6,295,656 B1 * 10/2001 Tillen ..... E03D 9/05 4/216
9,808,132 B2 * 11/2017 Smith ..... E03D 9/05
2001/0034899 A1 * 11/2001 Cardwell ..... E03D 9/05 4/216
2005/0138720 A1 * 6/2005 Shim ..... A47K 13/307 4/213
2006/0021119 A1 * 2/2006 Kline ..... E03D 9/05 4/213
2014/0298576 A1 * 10/2014 Gallardo Chaparro ... E03D 9/05 4/213
2016/0040415 A1 * 2/2016 Wafford ..... E03D 9/052 4/213
2017/0073952 A1 * 3/2017 Slover ..... E03D 9/05

* cited by examiner

*Primary Examiner* — Patrick M Buechner
*Assistant Examiner* — Benjamin R Shaw

(57) ABSTRACT

An odor elimination device for a toilet is provided. The device includes a "U"-shaped piece, a "Z"-shaped piece, and a plurality of sealing gaskets. The "U"-shaped piece is configured to be connected with a water inlet of the toilet, and the "Z"-shaped piece is configured to be connected with an exhaust tube. The "U"-shaped piece has a central orifice configured to be connected to the toilet and has two rectangular, parallel outlets separated by a recess in communication with the central orifice. The "Z"-shaped piece has two rectangular, parallel inlets configured to fit into the corresponding outlets of the "U"-shaped piece and are sealed by gaskets at a hollow vertical structure of the "Z"-shaped piece. A back face of the hollow vertical structure is configured to be connected to the exhaust tube via an outlet tube. The sealing gaskets sealing the "U"-shaped piece between the toilet and the flush tank.

1 Claim, 5 Drawing Sheets

DEVICE FOR ELIMINATED BAD ODORS IN TWO-PIECE TOILETS

BACKGROUND

1. Field

Aspects of embodiments of the present invention refer to an innovative two-piece odor elimination device for a toilet, the two pieces being connected between the toilet and a flush tank and being connected to an exhaust tube.

2. Description of the Related Art

While a toilet is in use, contaminated air (e.g., a contaminated air flow) will be generated inside the toilet and will travel (e.g., flow or move) to this device and will then travel to an exhaust tube. The contaminated air moves because a top part of the toilet only has water when the flush tank valve is activated. Due to low pressure (e.g., negative pressure) at the top and outer parts of the exhaust tube, air travels upwards and drags the contaminated air from inside the toilet to outside (e.g., to the outside of a residence, business, etc.).

Many and varied models of odor eliminators exist for toilets, such as exhaust fans and fragrance dispensers, but none of which has the technical features according to embodiments of the present invention.

SUMMARY

Embodiments of the present invention provide a device for eliminating bad odors in two-piece toilets (e.g., an odor elimination device) at a very low cost and without energy expenditure.

A device for eliminating bad odors in a two-piece toilet is provided. The device includes a plurality of hollow pieces, one of the hollow pieces being a "U"-shaped piece and another of the hollow pieces being a "Z"-shaped piece, and a plurality of sealing gaskets including a top gasket and a bottom gasket. The "U"-shaped piece is configured to be connected with a water inlet of the toilet, and the "Z"-shaped piece is configured to be connected with an exhaust tube. The "U"-shaped piece has a central orifice configured to be connected to a connection orifice of the toilet and has two rectangular, parallel outlets separated by a semicircular recess in communication with the central orifice. The "Z"-shaped piece has two rectangular, parallel inlets configured to fit into the rectangular, parallel outlets of the "U"-shaped piece and are sealed by a plurality of rubber gaskets located at a hollow vertical structure of the "Z"-shaped piece, a back face of the hollow vertical structure being connected to an outlet tube that is configured to be connected to the exhaust tube. The top and bottom gaskets are configured to seal the "U"-shaped piece between the toilet and the flush tank.

BRIEF DESCRIPTION OF THE DRAWINGS

The accompanying drawings illustrate exemplary embodiments of the present invention and, together with the description, explain aspects and features of the present invention. In the drawings.

DETAILED DESCRIPTION

Figure 1:
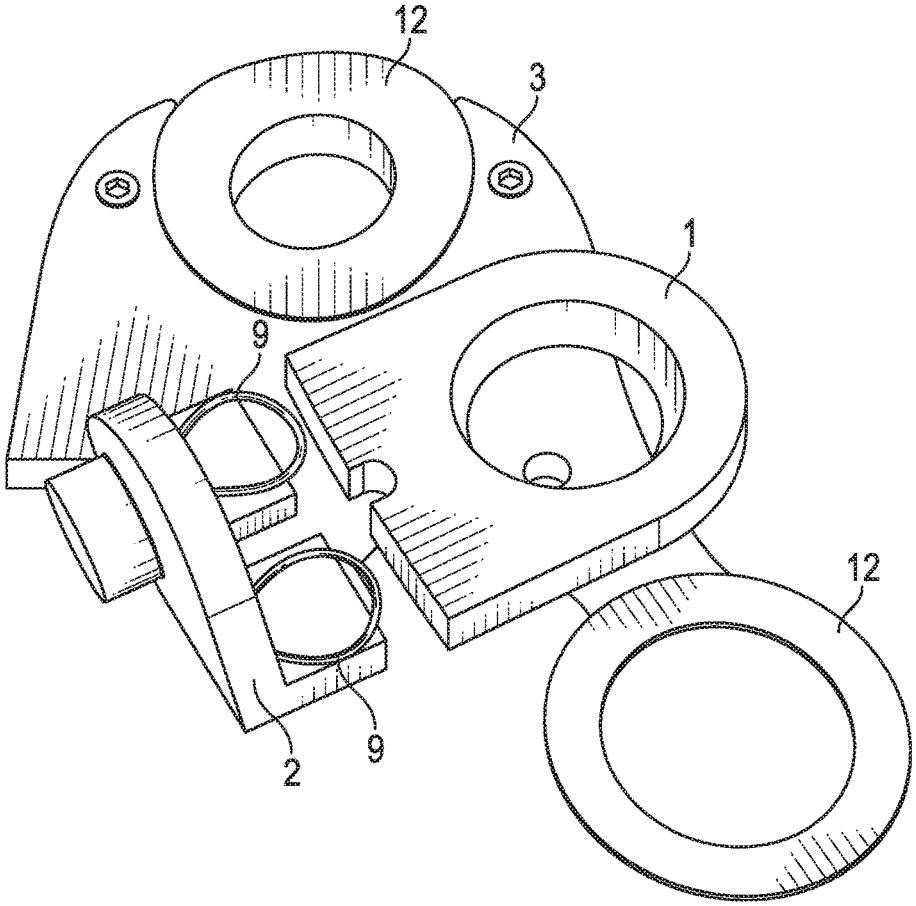
FIG. 1 is an exploded view of an odor elimination device according to an embodiment of the present invention on top of a toilet.

While the present invention is amenable to various modifications and alternative forms, exemplary embodiments thereof have been shown in the drawings and are described, in detail, below. The present invention is not limited to the particular embodiments described herein. The present invention covers all modifications, equivalents, and alternatives falling within the scope of the present invention as defined by the appended claims and their equivalents.

In the drawings, like numbers refer to like elements throughout, and the dimensions of structures, layers, etc. may be exaggerated for clarity. It will be understood that, although the terms first, second, etc. may be used herein to describe various elements, these elements should not be limited by these terms; these terms are used to distinguish one element from another element. For example, a first element could be termed a second element, and, similarly, a second element could be termed a first element, without departing from the scope of the inventive concept. Terms having a singular form may include plural forms unless referred to the contrary.

It will be further understood that the terms "includes," "including," "comprises," and "comprising," when used in this specification, specify the presence of stated features, integers, steps, operations, elements, components, or combinations thereof but do not preclude the presence or addition of one or more other features, integers, steps, operations, elements, components, or combinations thereof. Also, it will be understood that when an element, such as a layer, film, region, or substrate, is referred to as being "on" another element, it can be directly on the other element or intervening elements may also be present therebetween. When an element, such as a layer, film, region, or substrate, is referred to as being "under" another element, it may be directly under the other element or intervening elements may also be present.

As used herein, the term "and/or" includes any and all combinations of one or more of the associated listed items. Further, the use of "may" when describing embodiments of the present invention relates to "one or more embodiments of the present invention." Expressions, such as "at least one of," when preceding a list of elements, modify the entire list of elements and do not modify the individual elements of the list. Also, the term "exemplary" is intended to refer to an example or illustration. As used herein, the terms "use," "using," and "used" may be considered synonymous with the terms "utilize," "utilizing," and "utilized," respectively.

Figure 2A:
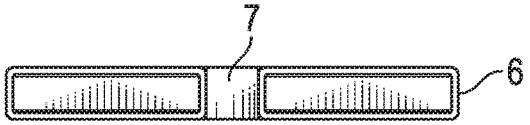
FIGS. 2*a* and 2*b* schematically show two views of a "U"-shaped piece of the odor elimination device.
Figure 2B:
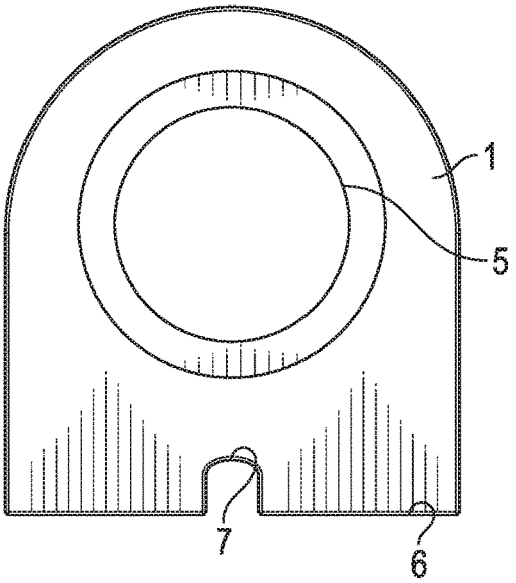
Figure 3A:
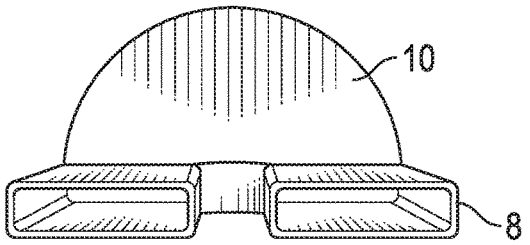
FIGS. 3*a* and 3*b* schematically show two view of a "Z"-shaped piece of the odor elimination device.
Figure 3B:
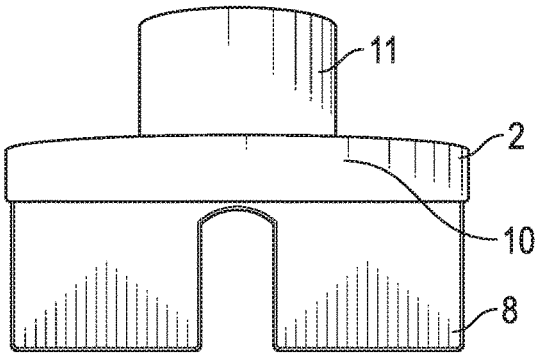
Figure 4A:
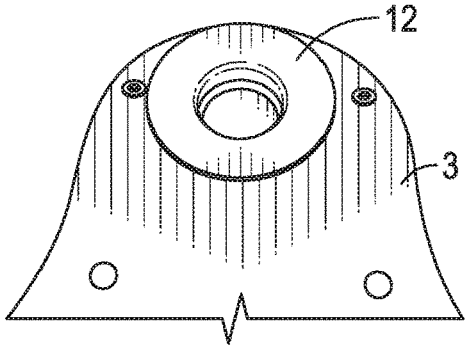
FIGS. 4*a*-4*d* schematically show an exploded view of an assembly sequence of the odor elimination device on the toilet.
Figure 4B:
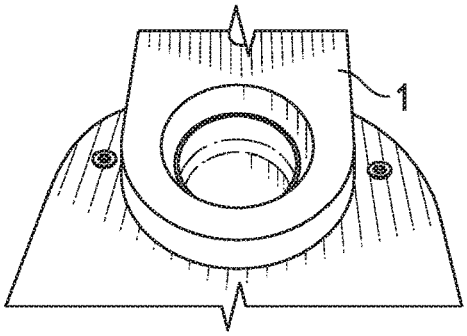
Figure 4C:
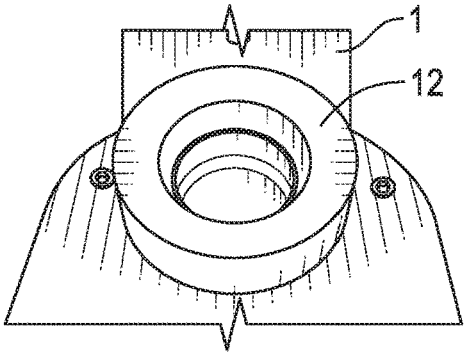
Figure 4D:
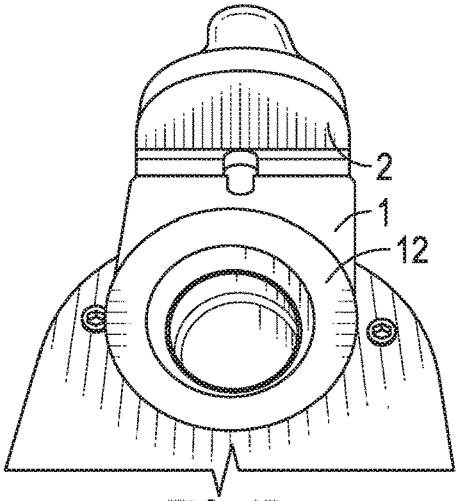
Figure 5:
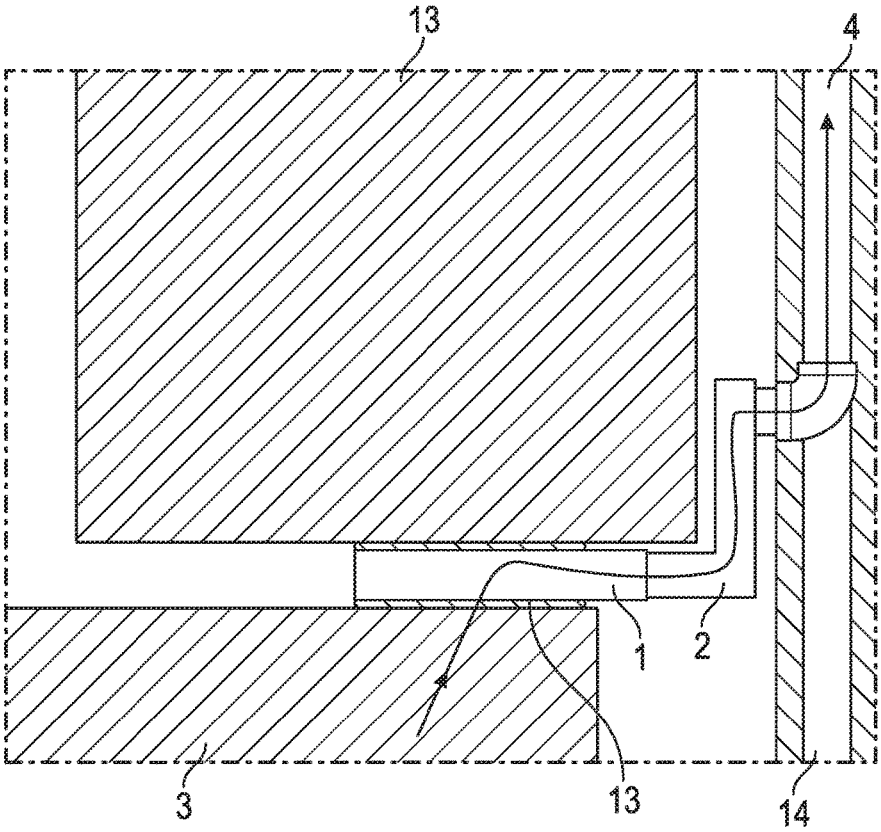
FIG. 5 is a schematic side view of the odor elimination device shown in FIGS. 4*a*-4*d* installed on the toilet and connected to an exhaust tube.

Referring to FIGS. 1-3, an odor elimination device according to an embodiment of the present invention includes two main hollow pieces, one of the hollow pieces having a "U"-shape (1) and the other one of the hollow pieces having a "Z"-shape (2). The "U"-shaped piece (1) is connected to a toilet water inlet (3), and the "Z"-shaped piece (2) is connected to an exhaust tube (4) (see, e.g., FIG. 5). The "U"-shaped piece (1) has a central orifice (5) (e.g., a central opening), which is compatible with a connection orifice of the toilet water inlet (3) and connects internally to (e.g., is in fluid communication with) two rectangular, parallel outlets (6). The outlets (6) are separated by a semicircular recess (7).

The "Z"-shaped piece (2) has two rectangular, parallel inlets (8) that respectively fit into the outlets (6) of the "U"-shaped piece (1) and are sealed against leaks by two rubber gaskets (9) (e.g., rings). The gaskets (9) are internally located at a hollow vertical structure (10), a back part of which connects to an outlet tube (11) to be connected with the exhaust tube (4).

The "U"-shaped piece (1) includes two sealing gaskets (12) (e.g., rings), one top gasket and one bottom gasket, which promote sealing when the "U"-shaped piece (1) is sandwiched between the toilet (3) and a flush tank (13).

Figure 6:
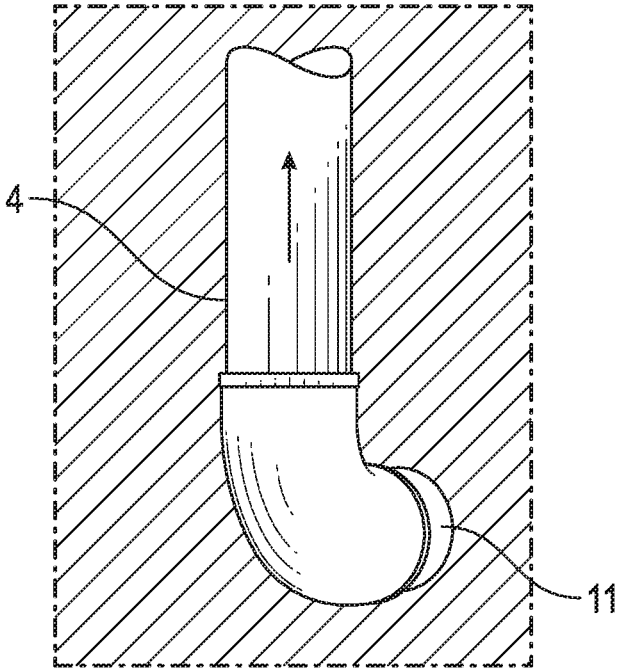
FIG. 6 is a schematic view through a wall illustrating how the odor elimination device connects to the exhaust tube.
Figure 7:
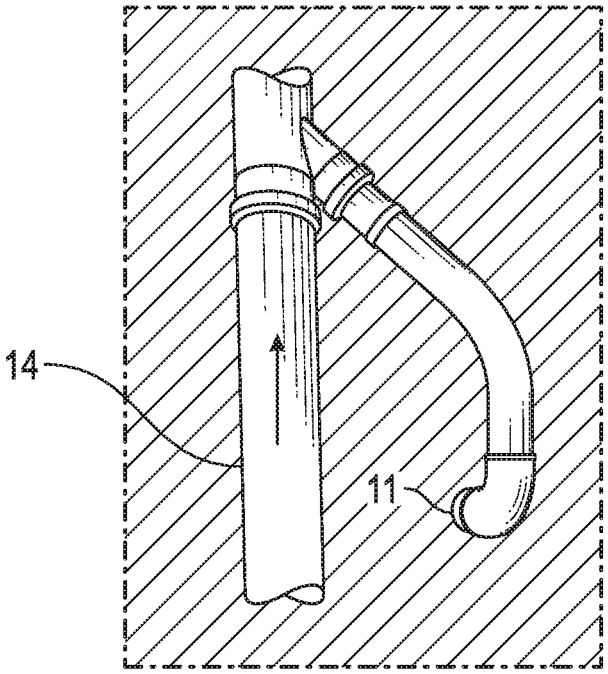
FIG. 7 is a schematic view through the wall of how the odor elimination device connects to the exhaust tube of a building.

Depending on a toilet to which the odor eliminating device is installed, the "Z"-shaped piece (2) may be connected to the exhaust tube (4) (see, e.g., FIG. 6) or, in buildings with more than one toilet (or restroom, etc.), may be connected to a main exhaust pipe (14) (see, e.g., FIG. 7). In both cases, the odor elimination device is below a junction point.

The "U"-shaped piece (1) is located between the toilet (3) and the flush tank (13) and is sealed by the two gaskets (12). The "Z"-shaped piece (2), which fits into the "U"-shaped piece (1), allows an overall length of the odor elimination device to be varied for implementation with various types of toilets (3) and has the two rubber gaskets (9) for sealing to (e.g., for a perfect fit with) the "U"-shaped piece (1), in addition to having room for a third fixing screw for the flush tank, if desired or necessary.

While the toilet is in use, contaminated air generated inside the toilet will flow to the "U"-shaped piece (1) then to the "Z"-shaped piece (2) and finally to exhaust tube (4) or (5). This happens because the top part of the toilet only has water when the flush tank valve is activated. Due to the low (e.g., negative) pressure at the top and outer part of the exhaust tube (4) or (5), the air flows (or moves) upwards and drags the contaminated air from inside the toilet to outside (e.g., outside of a residence, business, etc.).

The assembly sequence of the odor elimination device according to an embodiment occurs as follows. First, one of the gaskets (12) is set onto (e.g., is laid on) the toilet water inlet (3). Then, the "U"-shaped piece (1) is placed concentrically onto the gasket (12). Then, the "Z"-shaped piece (2) is attached to the back part of the "U"-shaped piece (1) such that both rectangular, parallel inlets (8) fit into the outlets (7) and are sealed against leaks by the two rubber gaskets (9). Then, the outlet tube (11) is connected to exhaust tube (4) or (14), and then, another gasket (12) is set onto (e.g., is laid on) the "U"-shaped piece (1). Finally, the flush tank (15) is attached onto the "U"-shaped piece (1) and fixed tightly to the toilet (3). The arrow in FIG. 5 indicates a path (or direction) the contaminated air takes to reach the outlet.

It should be noted that the odor elimination device according to embodiments of the present invention exhausts contaminated air from a toilet by using the natural exhausting of the toilet, and exhausts the contaminated air regardless of the exhaust conditions of the bathroom—either with natural or forced exhausting or without exhausting.

Although the present invention has been described with reference to exemplary embodiments thereof, it will be appreciated by those skilled in the art that it is possible to modify and change the described embodiments and the present invention in various suitable ways without departing from the spirit and scope of the present invention as set forth in the following claims and their equivalents, such that the scope of the present invention is defined not by the detailed description of the invention but by the appended claims and their equivalents

What is claimed is:

1. A device for eliminating bad odors in a two-piece toilet, the device comprising:

a plurality of hollow pieces, one of the hollow pieces being a "U"-shaped piece and another of the hollow pieces being a "Z"-shaped piece; and a plurality of sealing gaskets, the plurality of sealing gaskets comprising a top gasket and a bottom gasket, wherein the "U"-shaped piece is configured to be connected with a water inlet of the toilet, and the "Z"-shaped piece is configured to be connected with an exhaust tube, wherein the "U"-shaped piece has a central orifice configured to be connected to a connection orifice of the toilet and has two rectangular, parallel outlets separated by a semicircular recess in communication with the central orifice, wherein the "Z"-shaped piece has two rectangular, parallel inlets configured to fit into the rectangular, parallel outlets of the "U"-shaped piece and are sealed by a plurality of rubber gaskets located at a hollow vertical structure of the "Z"-shaped piece, a back face of the hollow vertical structure configured to be connected to an outlet tube that is configured to be connected to the exhaust tube, and wherein the top and bottom gaskets are configured to seal the "U"-shaped piece between the toilet and the flush tank.

* * * * *